US006634905B2

(12) United States Patent
Kuo

(10) Patent No.: US 6,634,905 B2
(45) Date of Patent: Oct. 21, 2003

(54) STACKED ELECTRICAL CARD CONNECTOR ASSEMBLY

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,558

(22) Filed: Dec. 19, 2001

(65) Prior Publication Data

US 2003/0114043 A1 Jun. 19, 2003

(51) Int. Cl.[7] ..... H01R 13/60
(52) U.S. Cl. ..... 439/541.5
(58) Field of Search ..... 439/541.5, 79, 439/630, 492, 495, 499

(56) References Cited

U.S. PATENT DOCUMENTS 5,267,876 A * 12/1993 Rupert et al. ..... 439/541.5
5,324,204 A * 6/1994 Lwee ..... 439/541.5
5,688,130 A * 11/1997 Huang ..... 439/541.5
5,967,831 A * 10/1999 Yamada et al. ..... 439/79
6,062,904 A * 5/2000 Oguchi et al. ..... 439/541.5
6,146,195 A * 11/2000 Chang ..... 439/541.5
6,478,615 B1 * 11/2002 Kuo ..... 439/541.5
6,482,030 B1 * 11/2002 Kuo ..... 439/541.5
6,540,552 B1 * 4/2003 Kuo ..... 439/541.5
6,551,131 B1 * 4/2003 Kuo ..... 439/541.5
6,558,192 B1 * 5/2003 Kuo ..... 439/541.5

* cited by examiner

*Primary Examiner*—Renee Luebke
*Assistant Examiner*—Felix O. Figueroa
(74) *Attorney, Agent, or Firm*—Wei Te Chung

(57) ABSTRACT

A stacked electrical card connector assembly (1) comprises an upper connector (10), a lower connector (20), and a FPC (flexible printed circuit) (30) connecting with the upper connector (10) and the lower connector (20). The FPC (30) includes a first contacting portion (32) having a plurality of spring arms (226) received in an opening of a lower frame (22) of the lower connector (20) and a second contacting portion (34) connected with a plurality of signal contacts (16) defined in an upper header (12) of the upper connector (20).

2 Claims, 7 Drawing Sheets

STACKED ELECTRICAL CARD CONNECTOR ASSEMBLY

BACKGROUND OF THE INVENTION

1. Field of the Invention

The present invention relates to the art of electrical connectors, more particularly to an improved electrical connector assembly for connecting two or more electrical cards to a printed circuit board (PCB).

2. Description of the Related Art

With the trend of reducing the size of a computer device, demand has arisen for increasing its data storage capacity at low cost. Generally, electrical cards, such as memory cards, are data storage devices which are electrically connected to the computer device. The electrical cards are portable instruments that are readily inserted and extracted from electrical connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors are arranged in "dual port" or stacked configurations. Examples of this electrical connector assembly are disclosed in U.S. Pat. Nos. 5,324,204 and 5,688,130. This electrical connector assembly commonly includes an upper connector and a lower connector stacked together for receiving two electrical cards therein and electrically connecting the two electrical cards to a PCB. This electrical connector assembly meets the requirement of high-capacity data transmission since it can simultaneously receive two same or different types of electrical cards therein. However, the whole size of the electrical connector assembly is not reduced at all since the electrical connector assembly is manufactured by simply stacking two single electrical connectors together. It is not suitable to install such electrical connector assembly in a Notebook-PC for it occupies too much space. Furthermore, signal contacts defined independently in an upper header of the upper connector and a lower header of the lower connector have to be directly soldered to the PCB or connected to the PCB through an independent transition device soldered on the PCB. One problem associated with soldering the entire signal contacts of the connector assembly to the PCB is that it is difficult to solder each individual tail and ensure that none of the closely spaced solder pads is short circuited to an adjacent solder pad. In addition, if the connector assembly need be replaced or removed from the PCB, the unsoldering process can be extremely labor intensive and costly.

SUMMARY OF THE INVENTION

Accordingly, an object of the present invention is to provide a stacked electrical connector assembly having reduced height thereby saving the occupied space on a PCB by the connector assembly.

Another object of the present invention is to provide a stacked electrical connector assembly with improved transition device which simplifies the assembling process of the connector assembly.

To achieve the above objects, a stacked electrical card connector assembly in accordance with the present invention comprises an upper connector, a lower connector, and a transition device respectively connected with the upper and lower connectors. The lower connector has a lower header and a lower metallic frame assembled to the lower header, and the lower frame has an opening defined therein. The upper connector has an upper header with a metallic shield, covered on the upper header and a plurality of signal contacts defined in the upper header. The shield has a plurality of grounding pins extending out from one edge thereof. The transition device has a first contacting portion and a second contacting portion. The first contacting portion has a plurality of spring arms extending into the opening of the lower frame. The second contacting portion has a plurality of solder holes respectively received the signal contacts of the upper header and grounding pins of the shield therein.

Using such a design, data of different electrical cards received in the upper and lower connectors can be simultaneously transferred through one transition device thereby decreasing the overall height of the connector assembly. The transition device can be connected to a PCB without soldering the transition device to the PCB such that the assembling process is simplified.

Other objects, advantages and novelty features of the invention will become more apparent from the following detailed description when taken in conjunction with the accompanying drawings. One copending application filed on Dec. 17, 2001, with an unknown serial number, the same title, the same applicant and the same assignee, also discloses another approach to solve the problem.

DESCRIPTION OF THE PREFERRED EMBODIMENT

Figure 1:
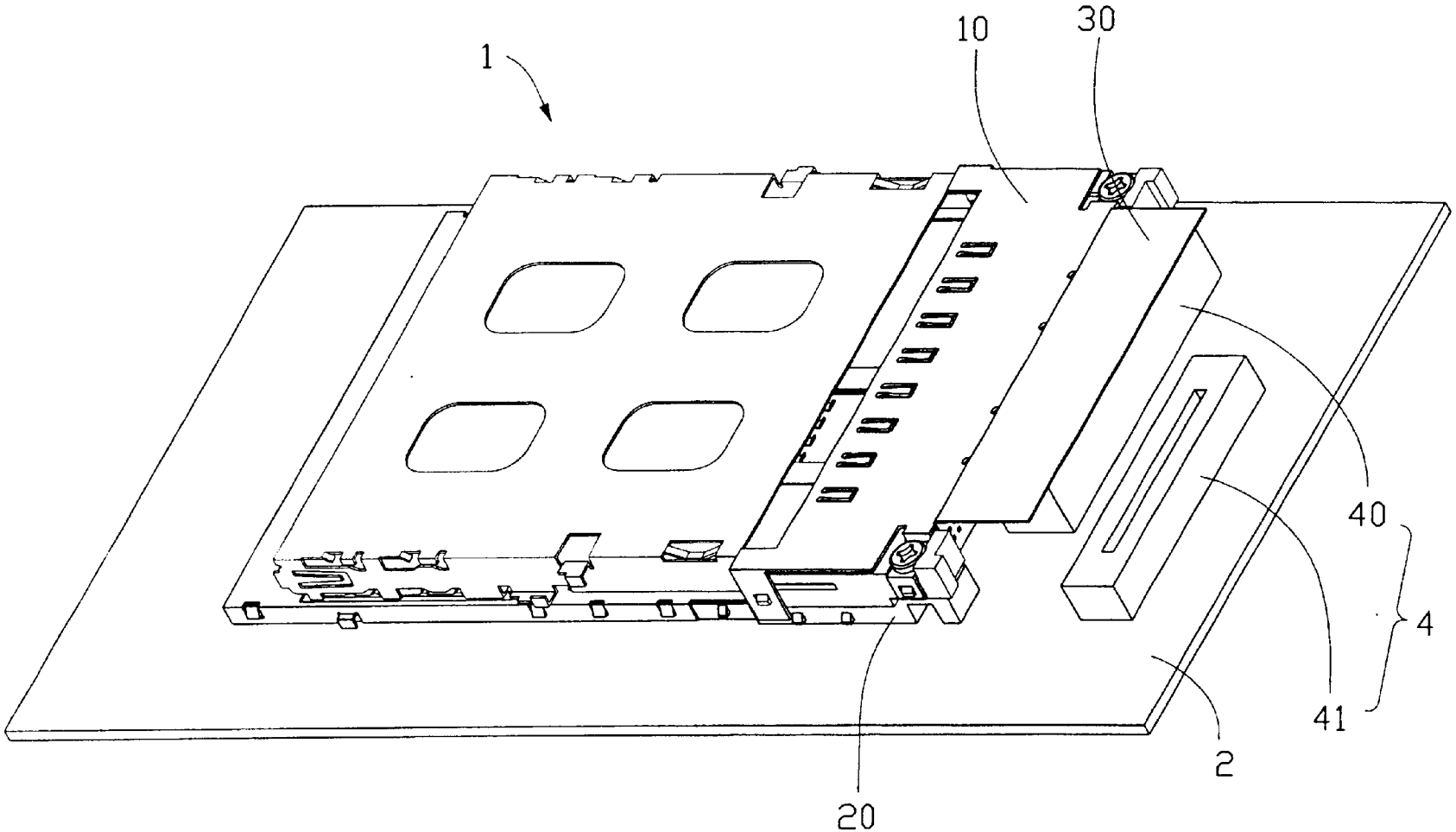
FIG. 1 is a perspective view of a stacked electrical connector assembly in accordance with a preferred embodiment of the present invention including a lower connector, an upper connector and a FPC (flexible printed circuit), in conjunction with a board-to-board connector and a PCB.

Reference will now be made to the drawing figures to describe the present invention in detail.

Referring to FIG. 1, a stacked electrical card connector assembly 1 in accordance with the present invention comprises an upper electrical connector 10, a lower connector 20, and a flexible printed circuit (FPC ) 30 for connecting both the upper connector 10 and the lower connector 20 with a printed circuit board (PCB) 2. The connector assembly 1 is mounted on the PCB 2 with a plug portion 40 of a board-to-board connector 4 connected with one end of the FPC 30, and a receptacle portion 41 of the connector 4 mounted on the PCB 2.

Figure 2:
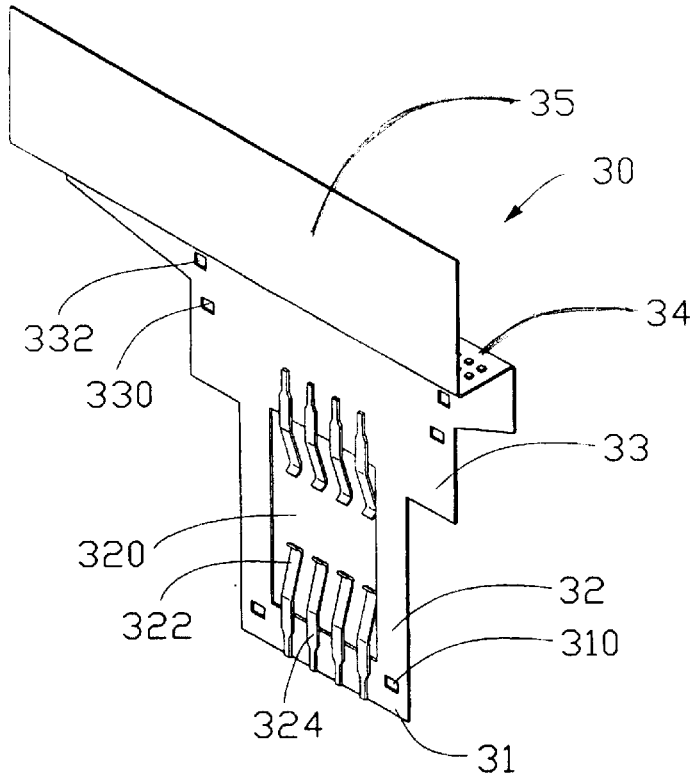
FIG. 2 is a perspective view of the FPC of FIG. 1, functioning as a transition device between electrical cards and the PCB.
Figure 3:
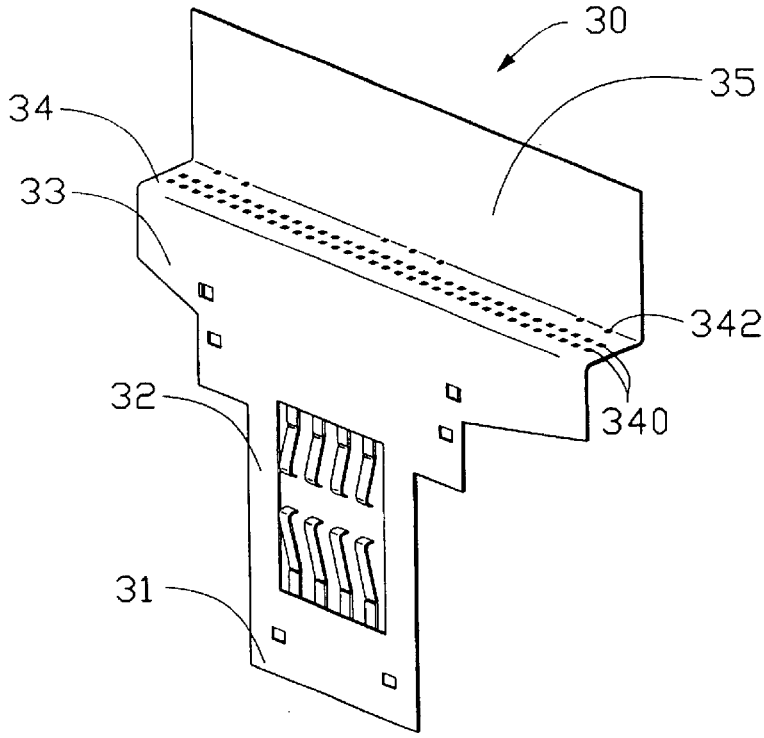
FIG. 3 is another perspective view of the FPC of FIG. 1.

Referring to FIGS. 2 and 3, the FPC 30 , functioning as a transition device, includes a first locking portion 31 defined at one end thereof, a tail portion 35 defined at the other end thereof, and a second locking portion 33 defined at a middle thereof. The first and second locking portions respectively define a plurality of securing holes 310, 330, 332 therein. A first contacting portion 32 is defined between the first and second locking portions 31, 33. The first contacting portion has an opening 320 and two rows of spring arms 322 defined in the opening 320. The spring arms 322 have tail portions 324 respectively soldered on the first and second locking portions 31, 33, and each spring arm 322 has a contacting end 326 extending in the opening 320. A second contacting portion 34 is defined between the second locking portion 33 and the tail portion 35. The second contacting portion 34 bends vertically and upwardly from the second locking portion 33, and defines two rows of first solder holes 340 at one side near the second locking portion 33 and one row of second solder holes 342 at the other side near the tail portion 35.

Figure 4:
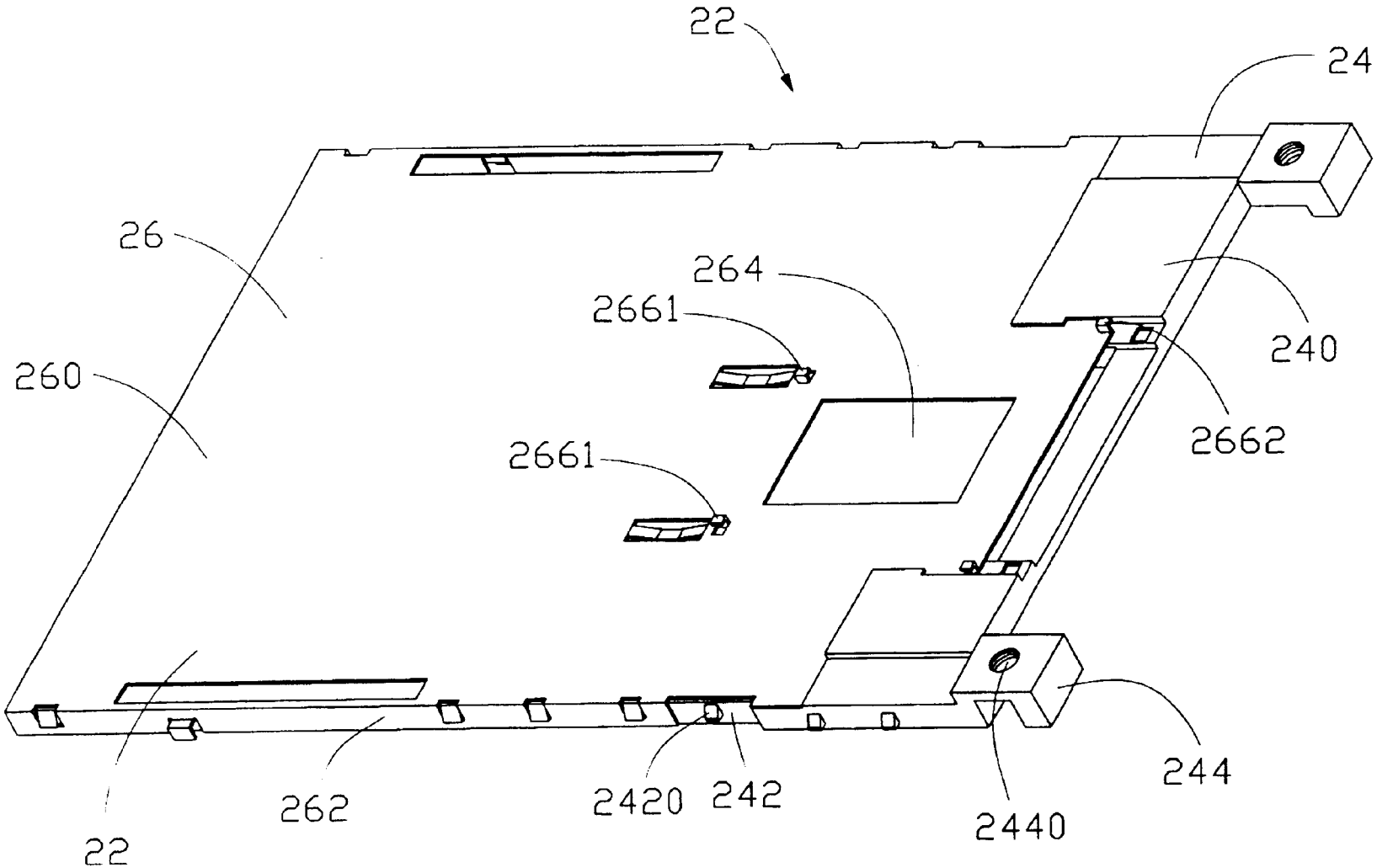
FIG. 4 is a perspective view of a lower frame of the lower connector of FIG. 1.

Referring to FIG. 4, a lower frame 22 of the lower connector 20 includes a lower insulative header 24 and a lower metallic shield 26 assembled on the lower header 24. The lower header 24 comprises a lower main body 240 and two parallel lower guiding arms 242 extending out from opposite ends of the main body 240. Each arm 242 has a plurality of ribs 2420. The header 24 further has a pair of locating blocks 244 defined at opposite ends thereof with a pair of screw holes 2440 respectively defined in the locating blocks 244. The shield 26 has a base plate 260, opposite sides of the base plate 260 are bent vertically and downwardly to form a pair of flanges 262, and a plurality of locking holes 2620 are opened along the fringes 262 for engaging with corresponding ribs 2420 of the lower header 24 to secure the base plate 260 on the lower header 24. The base plate 260 also defines an opening 264 near one side thereof. Two pairs of latches 2661, 2662 are respectively located behind two opposite side of the opening 264 such that the latches 2661, 2662 surround the opening 224.

Figure 5:
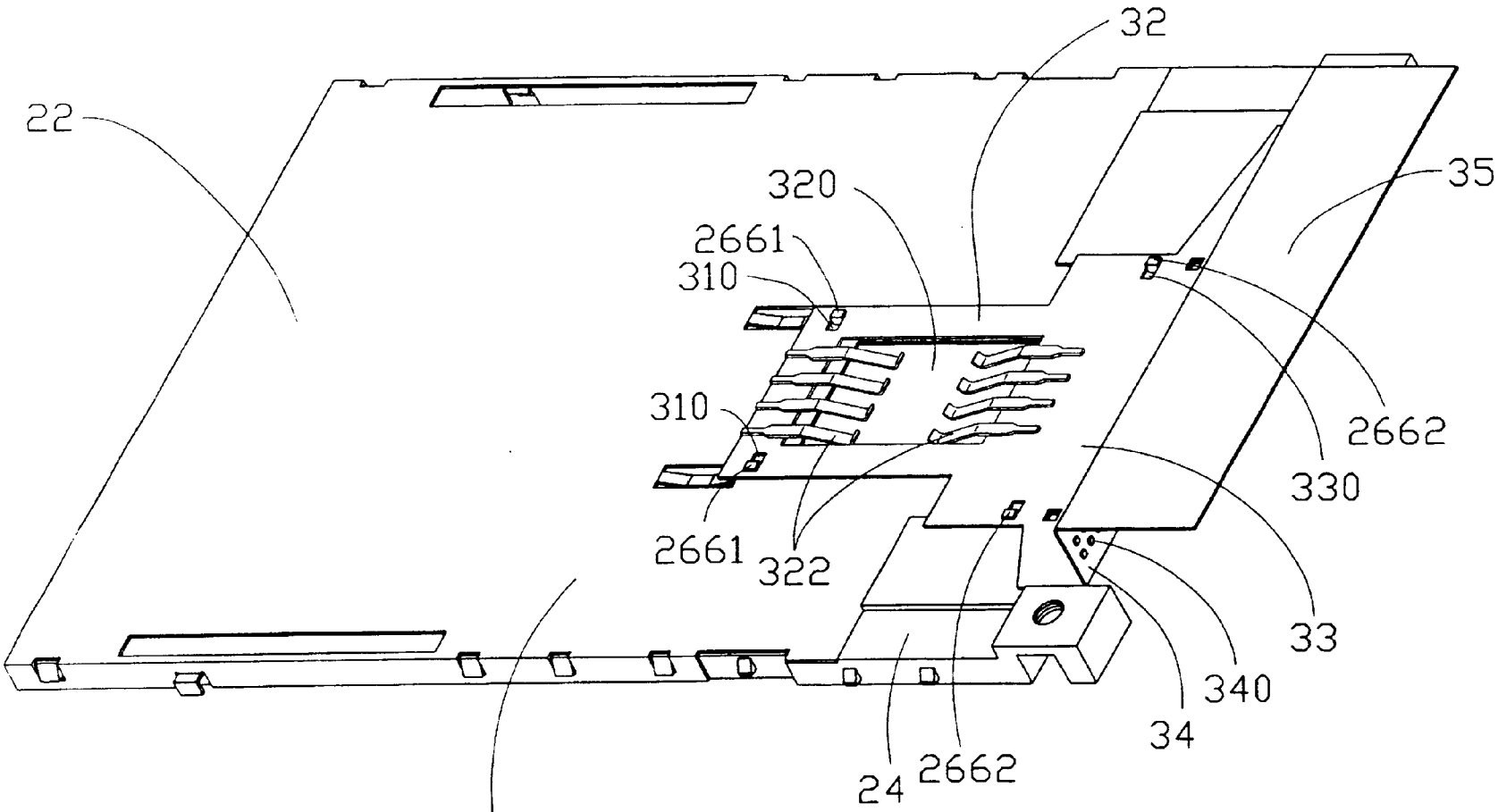
FIG. 5 is a perspective view showing the FPC of FIG. 2 connected with the lower frame of FIG. 4.

FIG. 5 shows the FPC 30 is assembled to the lower frame 22. The securing holes 310 of the first locking portion 31 of the FPC 30 engage with the latches 2661 of the shield 260 while the securing holes 330 of the second locking portion 33 of the FPC 30 engage with the latches 2662 of the shield 260 to secure the FPC 30 on the shield 260. At the same time, the opening 320 of the first contacting portion 32 of the FPC 30 is right over the opening 264 of the shield 260 with the spring arms 322 of the first contacting portion 32 extending into the opening 264 of the shield 260. Thus, the spring arms 322 of the FPC 30 contact with electrical paths of electrical card received in the lower connector 20 and transmit data therebetween. The second contacting portion 34 and the tail portion 35 of the FPC 30 are located over and beyond the main body 240 of the lower header 24.

Figure 6:
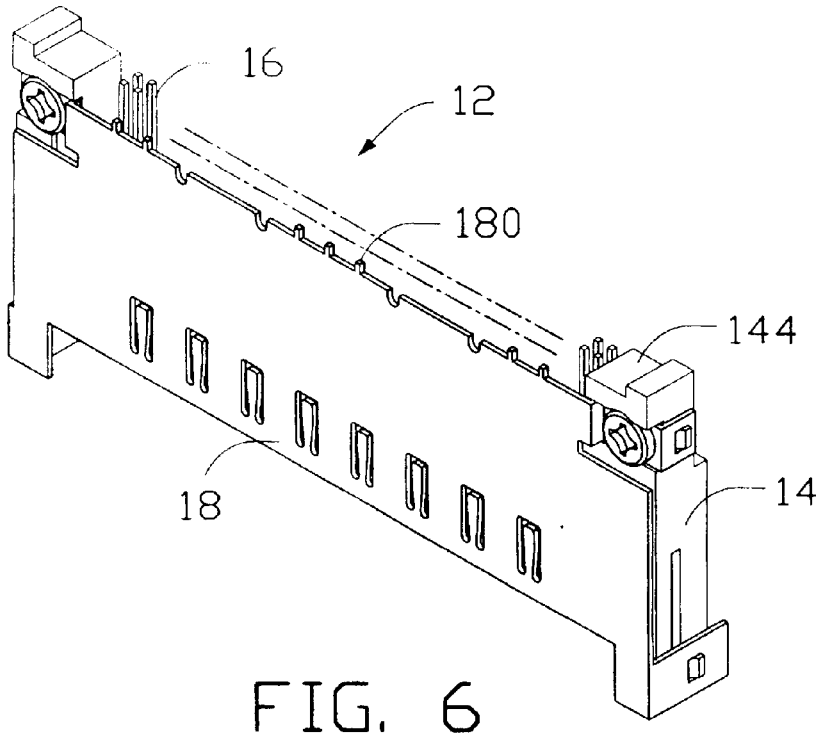
FIG. 6 is a perspective view of an upper header of the upper connector of FIG. 1.
Figure 7:
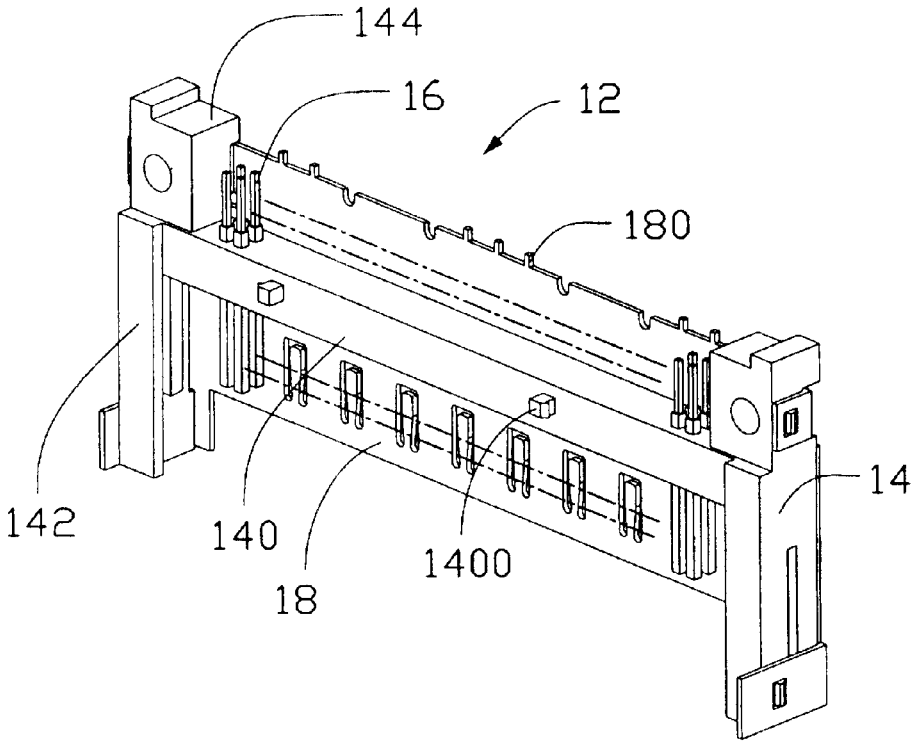
FIG. 7 is another perspective view of the upper header of FIG. 6.

Referring to FIGS. 6 and 7, an upper header 12 of the upper connector 10 comprises an insulative upper main body 14, a plurality of signal contacts 16 defined in the main body 14, and a metallic shield 18 covered on the main body 14. The main body 14 has a middle bar 140, a pair of spaced upper guiding arms 142 extending towards one side of the middle bar 140, and a pair of upper locating blocks 144 extending towards the other side of the middle bar 140. The signal contacts 16 are arranged in two parallel rows and inserted in the middle bar 140. The shield 18 is covered on a top surface of the main body 14 with a plurality of spaced grounding pins 180 extending from one edge of the shield 18. The middle bar 140 of the main body 14 further has a pair of latches 1400 defined on a bottom surface 1402 thereof.

Figure 8:
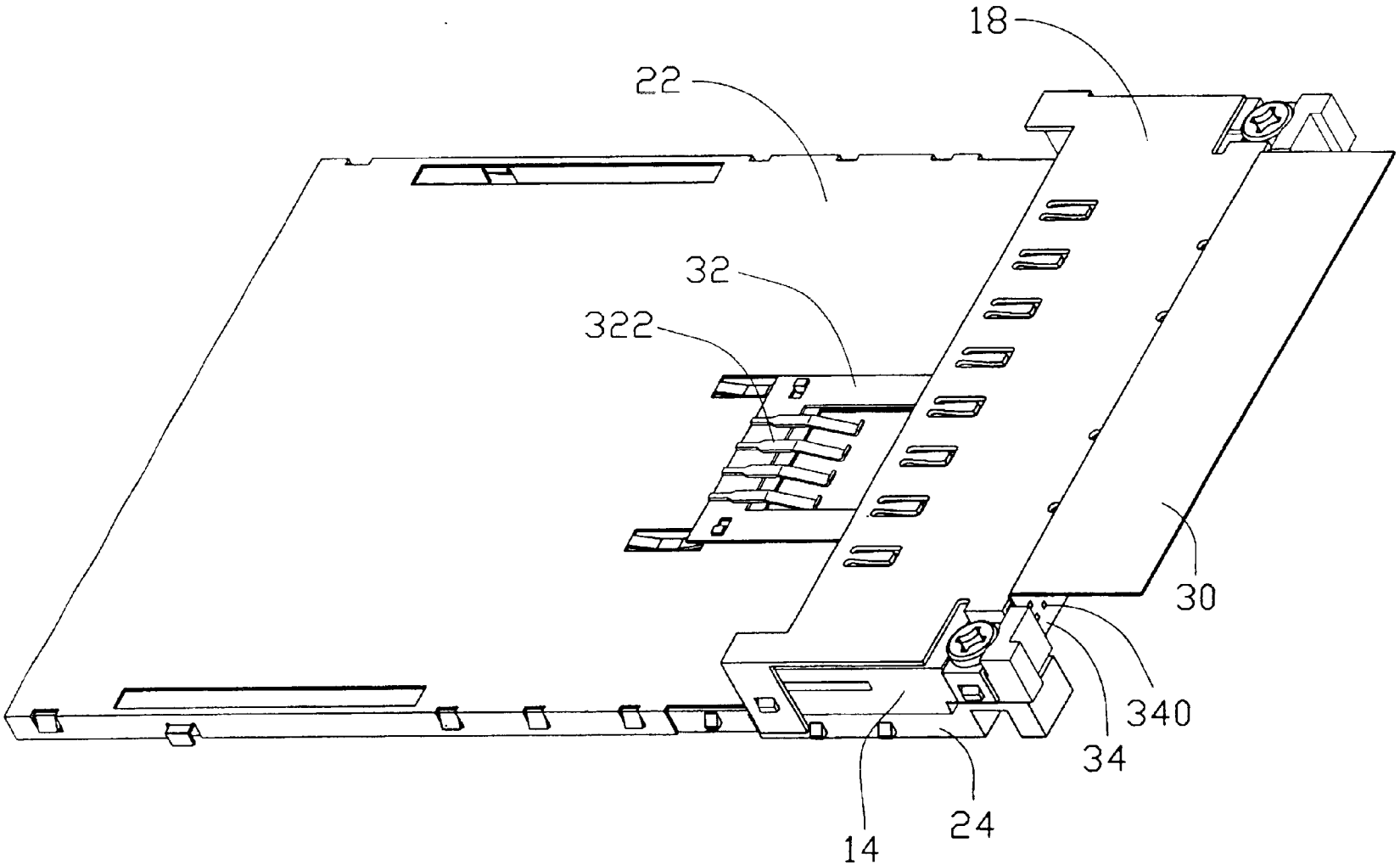
FIG. 8 is an assembled view of the lower frame, the FPC and the upper header.
Figure 9:
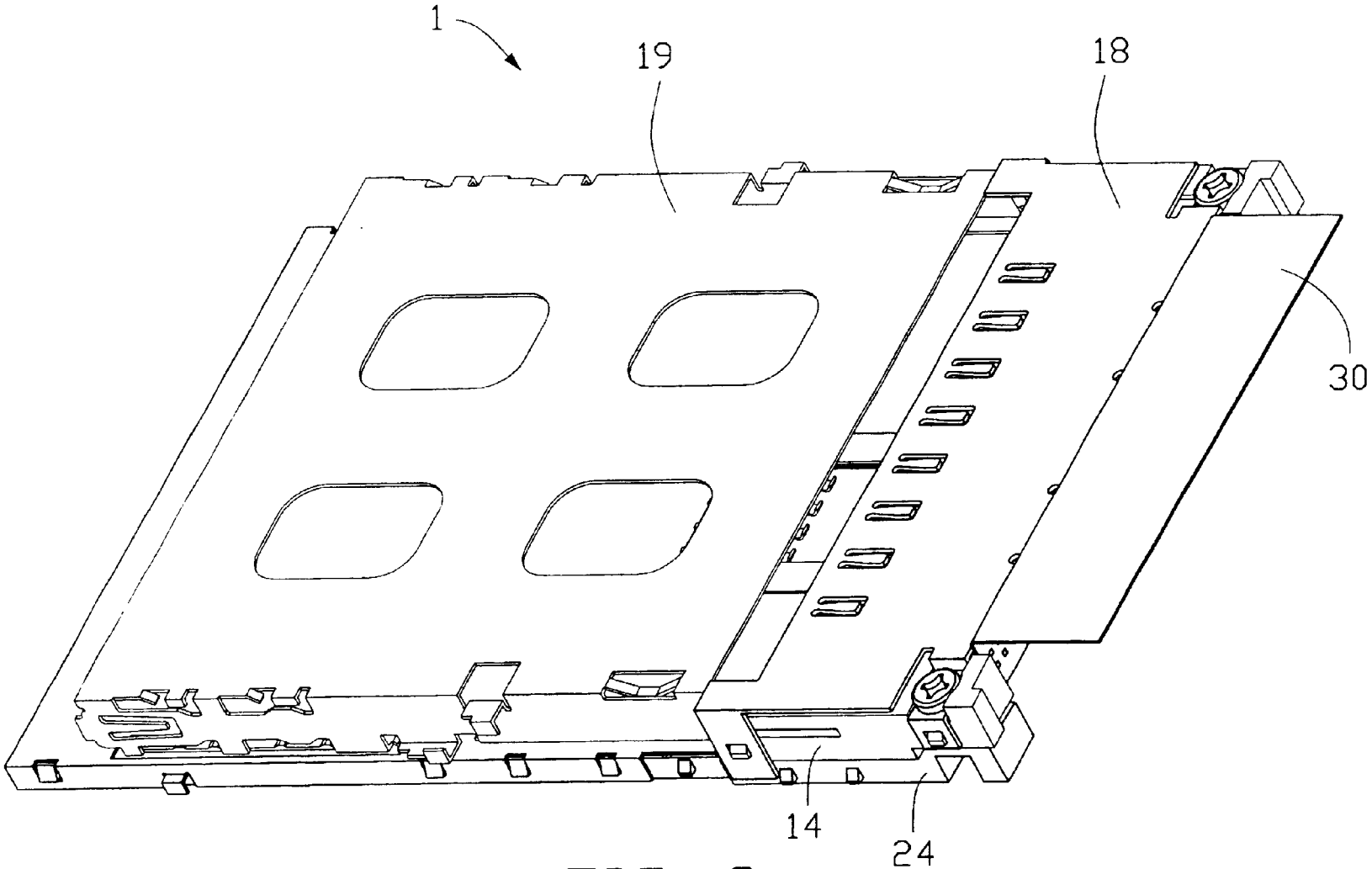
FIG. 9 is a perspective view of the electrical connector assembly of FIG. 1.

FIG. 8 shows the upper header 12 is assembled onto the lower connector 20. The upper header 12 is stacked on the lower header 24 of the lower connector 20 with the upper locating blocks 144 being positioned rightly over the lower blocks 244. The latches 1400 of the middle bar 140 of the upper header 12 extend through the openings 332 of the second locking portion 33 of the FPC 30 and connect with the lower header 24. Also, the two rows of signal contacts 16 of the upper header 12 are inserted into corresponding first solder holes 340 while the grounding pins 180 of the shield 18 are inserted into corresponding second solder holes 342. Therefore, data of an electrical card (not shown) received in the upper connector 10 can be transmitted through the FPC 30 to the PCB 2. Referring to FIG. 9, an upper frame 19 is stacked on the lower frame 22 and connected to the upper guide arms 142 of the upper header 12. Thus, the whole electrical connector assembly 1 is achieved.

Referring to FIG. 1 again, when the connector assembly 1 is mounted on the PCB 2, the FPC 30 acts as a transition device therebetween. One end of the FPC 30 simultaneously connects with the upper and lower connector 10, 20 while the other end of the FPC 30 connects with a plug portion 440 of a board-to-board connector 4. Therefore, data from the two electrical cards received in the upper and lower connector 10, 20 are transferred by the FPC 30 functioned as a transition device, and the FPC 30 can be expediently connected to a receptacle portion 41 of board-to-board connector 4 mounted on the PCB 2 without additional soldering operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly comprising:

an upper connector having an insulative upper header and a plurality of electrical contacts in the header for coupling to a first type card;

a lower connector having an insulative lower header and a metallic lower frame assembled to the header, said frame defining a receiving space therein; and a flexible printed circuit (FPC) defining a first contacting portion and a second contacting portion, the first contacting portion having a plurality of conductive spring arms extending from and along a plane of said FPC into said receiving space for coupling to a second type card, the second contacting portion being connected with the electrical contacts of the upper connector; wherein said FPC is electrically connected to a printed circuit board on which the connectors are mounted.

2. The assembly as claimed in claim 1 wherein said FPC is fastened to said frame.

* * * * *